US007637687B2

(12) United States Patent
Wagner

(10) Patent No.: US 7,637,687 B2
(45) Date of Patent: Dec. 29, 2009

(54) TREE GRILLE SYSTEM

(75) Inventor: Georg Wagner, Bruchsal (DE)

(73) Assignee: F. Von Langsdorff Licensing Ltd., Caledon, Ontario (CA)

( * ) Notice: Subject to any disclaimer, the term of this patent is extended or adjusted under 35 U.S.C. 154(b) by 455 days.

(21) Appl. No.: 11/575,439

(22) PCT Filed: Sep. 1, 2005

(86) PCT No.: PCT/EP2005/009407

§ 371 (c)(1),
(2), (4) Date: Mar. 16, 2007

(87) PCT Pub. No.: WO2006/029717

PCT Pub. Date: Mar. 23, 2006

(65) Prior Publication Data

US 2007/0274780 A1 Nov. 29, 2007

(30) Foreign Application Priority Data

Sep. 16, 2004 (DE) ..... 10 2004 044 712

(51) Int. Cl.
*E01C 11/22* (2006.01)
*B25G 3/00* (2006.01)

(52) U.S. Cl. ..... 404/2; 403/348; 404/4

(58) Field of Classification Search ..... 404/2, 404/4, 25, 26, 36, 39, 40, 53; 411/110, 123, 411/119; 292/1, 137, DIG. 38, DIG. 53, 292/DIG. 54, DIG. 64; 403/348, 107, 97; 285/81, 316; 47/23.1, 32, 32.2, 32.4, 65.6
See application file for complete search history.

(56) References Cited

U.S. PATENT DOCUMENTS 542,879 A * 7/1895 Evinof ..... 411/119

(Continued)

FOREIGN PATENT DOCUMENTS

DE 19940911 C1 3/2007

OTHER PUBLICATIONS esp@cenent database, English translation of abstract for DE 19940911, espacenet.com.

(Continued)

*Primary Examiner*—Thomas B Will
*Assistant Examiner*—Abigail A Risic
(74) *Attorney, Agent, or Firm*—Cahn & Samuels, LLP

(57) ABSTRACT

The invention relates to a tree grille system for covering tree grates. Said system consists of grille sections (1), which are interconnected by couplings (7) to form a self-supporting tree grille. The couplings (7) consist of two fixed coupling parts (8) configured on the grille sections (1) and a coupling part (9) that can be inserted between the other parts and then rotated into a locking position. An arc-shaped rib (18) is configured on the underside of the fixed coupling parts (8), the outer peripheral face (21) of said rib being configured as a ramp-type clamping surface (23). One section of said surface (23) is provided with undulating fluting (24). When the displaceable coupling part (9) is rotated into the locking position, teeth (34) that are formed on said part slide over the fluting (24), causing the displaceable coupling part (9) to be locked by a friction and positive fit in the locking position. Inserts (40), which can be introduced into two receiving holes (35) of the displaceable coupling part (9), comprise a pin (41) that projects outwards and engages in one of several arched bores (42) of the fixed coupling parts (8). This permits a more secure, positive-fit locking position to be achieved for the displaceable coupling part (9).

7 Claims, 2 Drawing Sheets

U.S. PATENT DOCUMENTS

Figure 1:
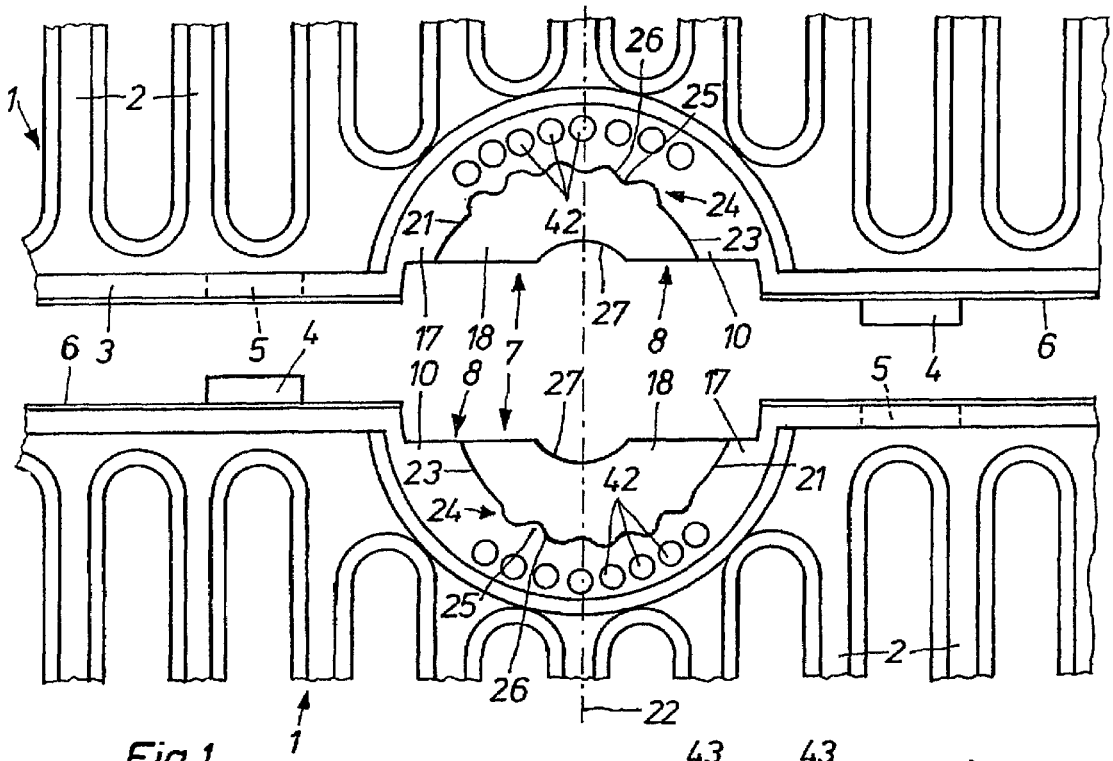

| | | | | | |
|---|---|---|---|---|---|
| 613,077 | A | * | 10/1898 | Richard | 411/124 |
| 814,516 | A | * | 3/1906 | Butterfield | 411/123 |
| 2,128,429 | A | * | 8/1938 | Olson | 411/123 |
| 2,355,922 | A | * | 8/1944 | Minero | 403/348 |
| 2,375,454 | A | * | 5/1945 | Wichert | 404/36 |
| 2,903,957 | A | * | 9/1959 | Bowman | 49/52 |
| 4,640,639 | A | * | 2/1987 | Matsui | 403/24 |
| RE32,663 | E | * | 5/1988 | Atkinson | 405/19 |
| 4,902,165 | A | * | 2/1990 | Embree | 404/25 |
| 5,288,165 | A | * | 2/1994 | Douwes Dekker | 404/35 |
| 5,462,382 | A | * | 10/1995 | Sauerwein et al. | 404/2 |
| 5,727,896 | A | * | 3/1998 | Buer et al. | 403/24 |
| 5,833,386 | A | * | 11/1998 | Rosan et al. | 404/36 |
| 6,119,546 | A | * | 9/2000 | Steffens, Jr. | 74/552 |
| 6,296,316 | B1 | * | 10/2001 | Hann | 297/463.1 |
| 6,662,508 | B1 | * | 12/2003 | Else | 52/177 |

OTHER PUBLICATIONS

European Patent Office, English translation of claims for EP1080631, http://www.worldlingo.com.

The International Bureau of WIPO, English translation of International Preliminary Report on Patentability for PCT/EP2005/009407, Apr. 24, 2007.

* cited by examiner

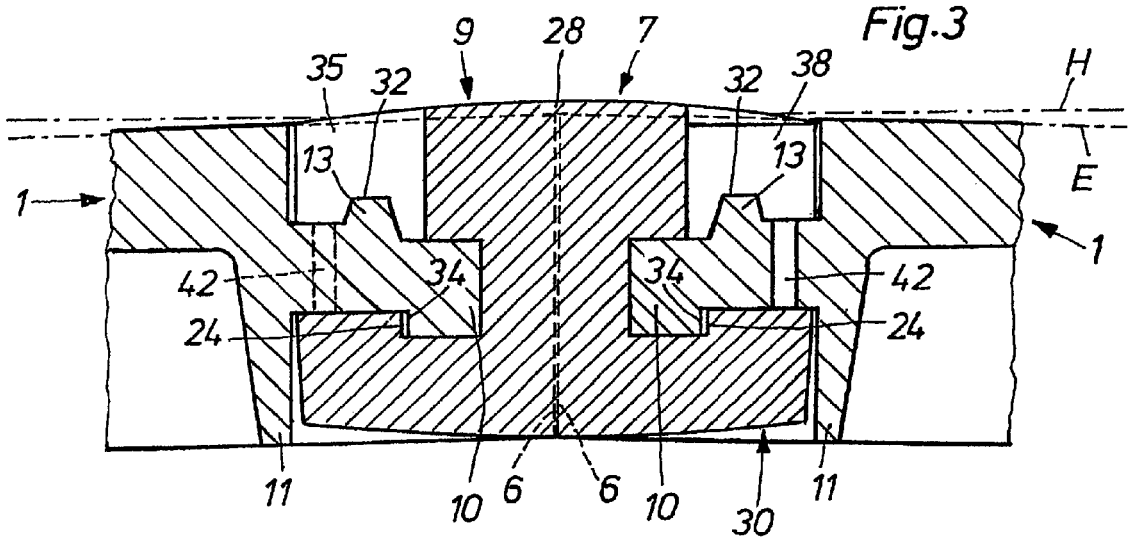
Fig.3
9
28
7
35
32
32
38
H
13
13
E
1
1
42
34
34
42
24
24
11
10
6
6
10
30
11
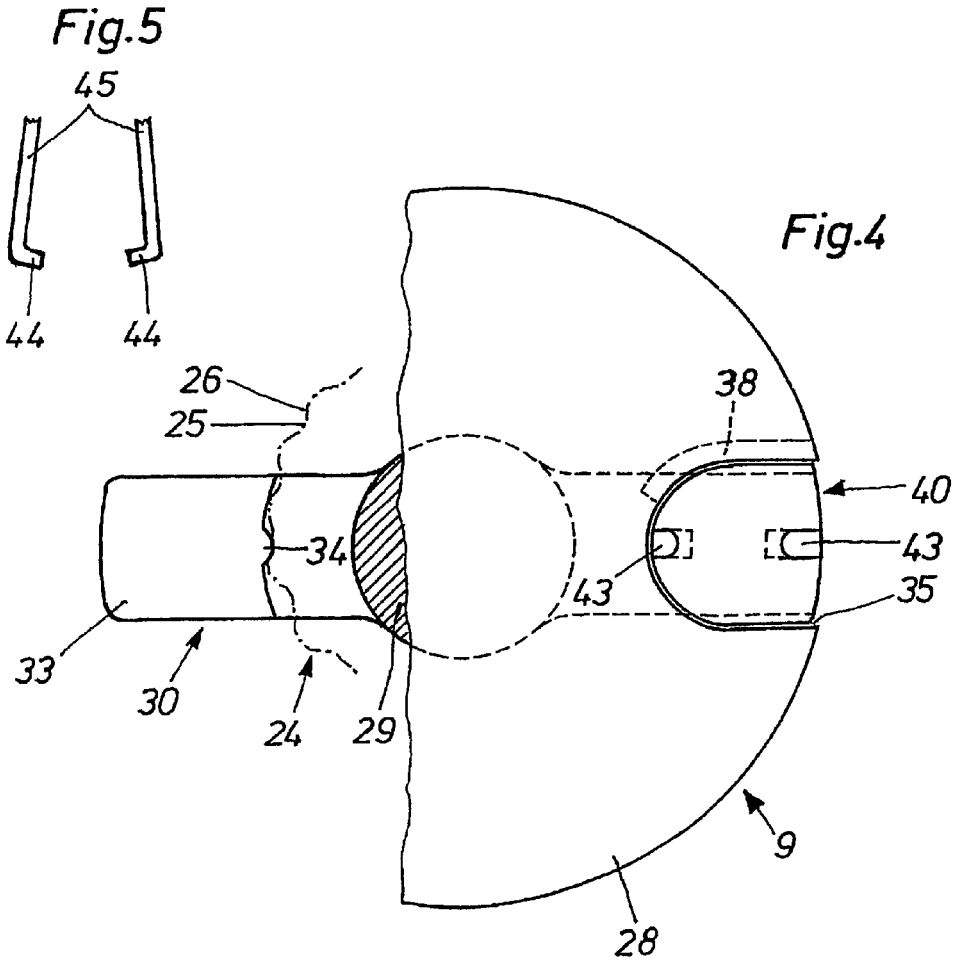
Fig.5
45
44
44
Fig.4
26
25
38
40
34
43
43
35
33
30
24
29
9
28

TREE GRILLE SYSTEM

This application is the National Stage of International Application No. PCT/EP2005/009407, filed on Sep. 1, 2004, which claims priority to Application No. 10 2004 044 712.8 filed in Germany on Sep. 16, 2004. The entire contents of these prior applications are incorporated herein by reference.

I. FIELD OF INVENTION

The invention relates to a tree grille system for covering tree grates.

II. BACKGROUND OF THE INVENTION

The German Patent Specification DE 199 40 911 C1 discloses a tree grille system, in which several grille sections are interconnected by means of couplings to form a continuous, self-supporting tree grille. The couplings consist of two fixed coupling parts configured on the grille sections and a coupling part, which can be inserted between the two fixed coupling parts and then rotated into a locking position. The fixed coupling parts are formed by segment pieces, which comprise a ramp-type clamping surface on the underside. The displaceable coupling part consists of a discoidal head, a bolt-shaped center part and a two-armed crossbar, the two end regions of which are directed upwardly and can be brought into active connection with the ramp-type clamping surface of both the fixed coupling parts. A part of these ramp-type clamping surfaces is provided with a flat undulating or dented fluting, to which a flat tooth, which can be engaged in the depressions of the fluting, is assigned on each of the end regions of the crossbars. The aim of this configuration of the coupling is to lock the coupling part not only by a friction fit, but also by a form fit by engaging the teeth in the depressions when the displaceable coupling part is rotated into the locking position.

It has been seen that in the production of the grille sections consisting of cast iron, it is difficult with respect to casting technology, to manufacture and possibly rework a fluting provided on the underside of the ramp-type clamping surfaces, which extend at a flat angle to the plane of the grille sections. Furthermore, it is possible that the intended form-fit locking of the displaceable coupling part is achieved imperfectly if this coupling part is rotated into the locking position using an extremely small torque.

III. SUMMARY OF THE INVENTION

It is therefore the object of the invention to design the coupling such that it can be manufactured more easily and that the displaceable coupling part can be locked into the locking position more securely than hitherto possible. This objective is attained by the characterizing features of claim 1.

Due to the measure of configuring the ramp-type clamping surface of the fixed coupling parts on the peripheral side of a rib disposed on the underside of the segment pieces and of providing the fluting accordingly on this peripheral side of the rib, the longitudinal sides of the depressions and elevations of the fluting extend perpendicularly to the plane of the grille sections. Since a fluting disposed in such a manner is more easily accessible than a fluting in which the longitudinal sides of the depressions and elevations extend parallel to the plane of the grille sections, a possibly necessary reworking of the fluting is clearly simplified when producing the casting molds for the grille sections.

Due to the additional measure of inserting an insert into the receiving holes of the displaceable coupling part, said receiving holes being provided for a hook wrench, and the insert thereby filling out these holes, wherein a pin fixedly connected to the insert engages in one of several bores, which are disposed in a circular arc-shaped manner in the respective segment piece of both the fixed coupling parts, an absolutely secure form-fit locking of the displaceable coupling part is achieved even if the coupling part has not been rotated properly into the locking position using the prescribed target torque. In this manner the displaceable coupling parts are now secured in the best way possible against an automatic release from the locking position, with the result that dynamic loads of the tree grille also, as can arise e.g. in the case of vibrations and brake applications and starting procedures of motor vehicles, cannot endanger the stability of the tree grille.

Since in the case of the fixed coupling parts, the ramp-type clamping surface is configured in an inventive manner on the peripheral side of an arc-shaped rib, which is directed downwards from the underside of the segment piece, the fixed coupling parts are locked in place by tightening them against one another only in the horizontal direction, i.e. the direction extending parallel to the plane of the grille sections when locking the coupling. Due to this the sidewalls of the grille sections are pressed against one another in the longitudinal and cross directions. In this manner the grille sections are joined to form a tree grille, which is stiff, bend-proof and thus particularly highly loadable. This effect can be further intensified if the sidewalls according to claim 2 are configured such that they extend by a small measure obliquely inwardly. Due to this measure, two grille sections pressed on one another extend at a very flat angle towards one another. Consequently, the tree grille, which usually consists of a plurality of grille sections, is flatly arched upwardly in the unloaded state and thus is even more loadable than if it were extending in a planar form.

The refinement of the invention according to claim 3, as per which one bore for the pin of the insert is assigned to each depression and each rising flank of the fluting, makes it possible to lock the displaceable coupling part in finely stepped increments.

Due to the measure according to claim 4, as per which the inserts contain receiving openings for a handling tool, the inserts can be removed from the respective receiving hole of the displaceable coupling part only with the help of such a handling tool. Unless these handling tools are simple auxiliaries that are available to everyone, instead of being only special tools, it is possible in this manner to prevent unauthorized persons from pulling out the inserts from the receiving holes and thus nullifying the form-fit locking of the displaceable coupling parts.

In one aspect, the present invention provides a tree grille system for covering tree grates, the tree grille system comprising: a) several grille sections, the sections being interconnected by couplings to form a continuous, self-supporting tree grille, the outer edge of which rests on a support bearing; b) the couplings consisting of two fixed coupling parts, which are each configured on two adjoining grille sections and which are arranged at a distance between one another, and a displaceable coupling part, which can be inserted between the two fixed coupling parts and then rotated into a locking position; c) the fixed coupling parts being formed of segment pieces comprising a ramp-type clamping surface; d) at least one part of the ramp-type clamping surface being provided with a flat undulating or dented fluting; e) the displaceable coupling part comprising a discoidal head having two receiving holes for a hook wrench a bolt-shaped center part and a two-armed cross bar having an upwardly directed extension on each arm, wherein the extensions are adapted to engage the ramp-type clamping surfaces; f) at least one flat tooth provided on the extensions, the tooth being capable of being locked into place in depressions of the fluting; g) an arc-shaped recess, which extends parallel to the plane of the grille sections and an arc-shaped rib, which delimits the recess and likewise extends parallel to the plane of the grille sections, the recess and arc being provided on the underside of the segment pieces, and wherein the ramp-type clamping surface is formed on the outer peripheral side of the rib; h) at least one part of the outer peripheral side of the rib being provided with the flat undulating or dented fluting; i) the tooth, which is capable of being locked into place in the fluting, being configured on the inner side of both the extensions; and j) the system further including inserts, each capable of being inserted into the receiving holes of the displaceable coupling part and thereby filling the receiving hole, engage with a downwardly projecting pin in one of several bores disposed in a circular arc-shaped manner in the respective segment piece of both the fixed coupling parts.

IV. BRIEF DESCRIPTION OF THE DRAWINGS

Figure 2:
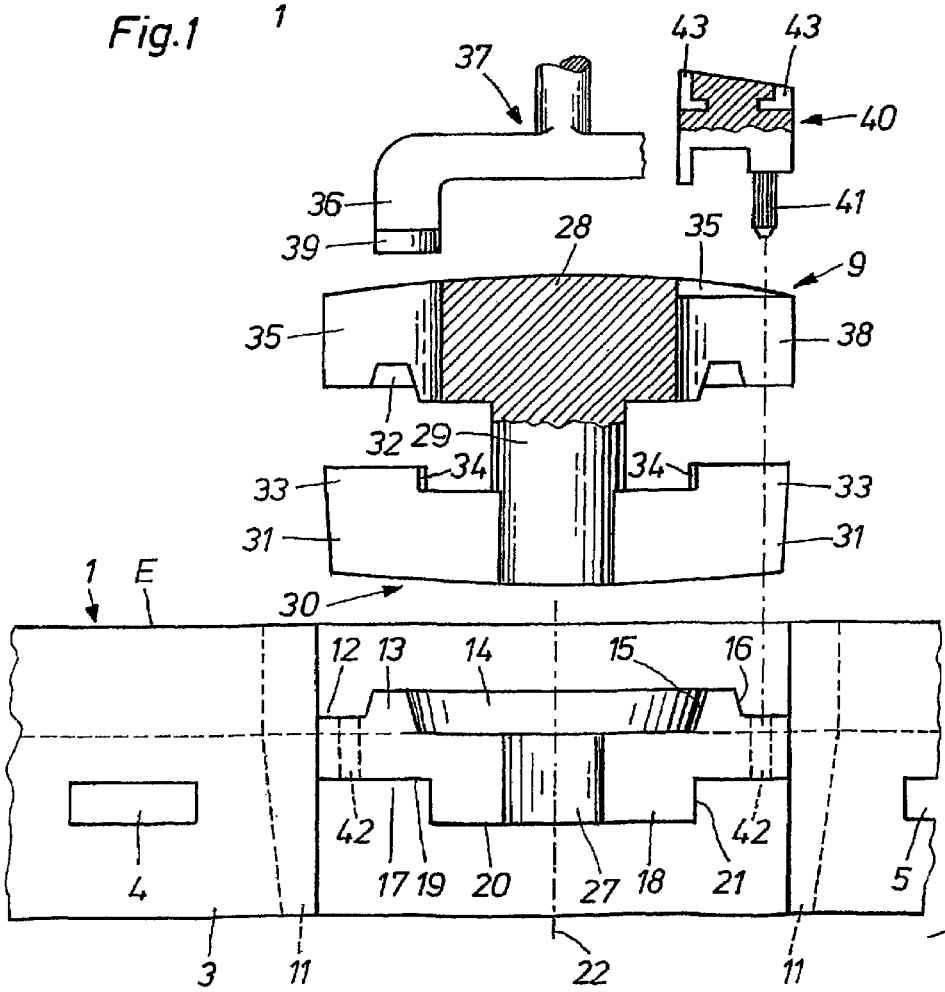

These and other features of the invention will become more apparent in the following detailed description in which reference is made to the appended drawings wherein:

The invention is explained below with reference to an exemplary embodiment illustrated in the drawing, of which:

FIG. 1 shows a plan view of the underside of two partially illustrated grille sections having a small distance between one another, FIG. 2 shows a view of a part of a grille section having a fixed coupling part, a partial section of a displaceable coupling part, a view of a part of a hook wrench and a partial section of an insert, FIG. 3 shows a sectional view of an assembled coupling having a displaceable coupling part, which is located in the locking position, FIG. 4 is a plan view of a partially illustrated rotatable coupling part and an insert, and FIG. 5 is a view of a partially illustrated handling tool.

V. DETAILED DESCRIPTION OF THE INVENTION

In a manner known per se, the tree grille system comprises a number of grille sections 1, said number being dependent on the size and shape of the area to be covered. The grille sections can be provided with a square, rectangular or circular segment shape for forming variably configured tree grilles.

The grille sections 1 comprise a plurality of downwardly tapering ribs 2 and are provided with circumferentially extending strips 3, which project downwardly beyond the underside of the ribs 2 and thus increase the flexural stiffness of the grille sections 1. As shown in FIG. 1, rectangular projections 4 and correspondingly shaped grooves 5 are configured alternately and at equal distances on the strips 3. When two grille sections 1 are placed together, the projections 4 slide into the grooves 5 and thus enable an accurate alignment of the grille sections 1 and a stiffening of the assembled tree grille. The outer sidewalls 6 of the strips 3 are tapered inwardly by a small measure starting from the topside of the grille sections 1. Due to this taper, two grille sections 1 with abutting sidewalls 6 extend at a flat angle towards each other. The dash-dotted line H illustrates this in FIG. 3 and marks the course of a horizontal plane.

The grille sections 1 can be detachably connected by means of couplings 7 to form a continuous tree grille. The couplings 7 consist of two fixed coupling parts 8, which are configured in the border area of the grille sections 1 and which face one another with a small distance therebetween after the assembly of the two grille sections 1. The couplings 7 also consist of a displaceable coupling part 9, which can be inserted between the two fixed coupling parts 8 and which can then be rotated into a locking position.

Each fixed coupling part 8 is formed by a segment piece 10, which is disposed in the center region of a semi-circular extension 11 of the respective grille section 1 and is a fixed component of this extension 11. The extension 11 projects downwards like the strips 3, the underside of the extension 11 being aligned with that of the strips 3.

Seen from the outside to the inside, a groove-type arc-shaped recess 12, an arc-shaped rib 13 and a semi-circular depression 14 are configured on the topside of each segment piece 10. As shown in FIGS. 2 and 3, the inner and outer wall 15 and 16 of the rib 13 are configured to be inclined in such a way that the cross-section of the rib 13 increases in width downwardly.

Seen from the outside to the inside, a groove-type, arc-shaped recess 17 and an arc-shaped rib 18 are configured on the underside of each segment piece 10. The bottom surface 19 of the recess 17 and the front surface 20 of the rib 18 extend parallel to the plane E of the respective grille section 1. The lower peripheral side 21 of the rib 18 is located at a distance from the centerline 22 of the extension 11, wherein said distance increases from one end of the rib to the other, and the lower peripheral side thus forms a ramp-type clamping surface 23. A part of the outer peripheral side 21 is provided with a flat undulating fluting 24. Its depressions are marked with the reference numeral 25; the rising flanks are marked with the reference numeral 26. A half cylindrical bore 27 is contained at the center of each segment piece 10.

The displaceable coupling part 9 consists of a discoidal head 28, a bolt-shaped center part 29 and a crossbar 30, which is formed by two short laterally protruding arms 31. An annular groove 32, the location, shape and size of which corresponds to those of rib 13 of the fixed coupling parts 8, is provided on the underside of the head 28. The height of the head 28 is configured such that its edge is aligned with the topside of the grille sections 1 when the coupling part 9 is inserted into the coupling position. The topside of the head 28 is convexly shaped due to which the center region of the head 28 projects slightly over the topside of the grille sections 1. This brings about a widening of the cross-section of the head 28 in the center region and consequently increases its flexural stiffness.

An upwardly directed extension 33 is configured on the ends of each arm 31. A centrally inwardly projecting flat tooth 34 is configured on the inner side of both the extensions 33, which tooth corresponds to the fluting 24 on the outer peripheral side 21 of the rib 18. The lower side of the crossbar 30 is shaped convexly due to which the arms 31 taper upwardly.

Two receiving holes 35 for correspondingly designed socket pins 36 of a hook wrench 37 illustrated in FIG. 2 are formed in the heads 28 of the displaceable coupling parts 9, said receiving holes being disposed at a distance from one another. The receiving holes 35 contain lateral undercuts 38 for laterally projecting extensions 39 of the socket pins 36. The extensions 39 are disposed on those sides of the socket pins 36, which are located at the front in the rotational direction of the hole.

Inserts 40 can be inserted into each of the receiving holes 35 of the displaceable coupling part 9, the shape and size of said inserts corresponding to those of the receiving holes 35, thereby closing the receiving holes largely after being inserted therein. The inserts 40 comprise a downwardly projecting pin 41. Several bores 42 disposed in a circular arc-shaped manner are configured in the segment piece 10 of the fixed coupling parts 8 for the purpose of receiving these pins 41, one bore 42 being assigned to each depression 25 and each rising flank 26 of the fluting 24.

The inserts 40 comprise upwardly accessible receiving openings 43, which have an L-shaped course. Likewise L-shaped end pieces 44 of a handling tool 45, which is made of spring steel and is illustrated only partially, can be inserted into the receiving openings 43.

When assembling a tree grille, the grille sections 1 to be interconnected are joined together such that the projections 4 engage in the grooves 5. In this manner both the joined grille sections 1 are perfectly aligned in the vertical and in the horizontal direction extending parallel to the sidewalls 6 that contact one another. Thereafter, displaceable coupling parts 9 are each inserted into the interspace between two fixed coupling parts 8. When the two grille sections 1 contact one another with their sidewalls 6, the displaceable coupling part 9 arrives directly into its insertion position, which forms the starting position for its rotation into the locking position.

However, if both the grille sections 1 have a larger distance from one another in the joining direction, the displaceable coupling part 9 is initially placed with the underside of the head 28 on the topside of the arc-shaped rib 13. If the two grille sections 1 are now moved closely towards one another, the lower part of the inclined outer lateral contact surface of the annular groove 32 of the displaceable coupling part 9 comes into contact with the upper part of the inclined outer wall 16 of the arc-shaped rib 13 of both the fixed coupling parts 8. The partially inserted displaceable coupling part 9 already brings about its form-fit connection with the fixed coupling parts 8, said form-fit connection acting in the horizontal plane. Since the two grille sections 1 to be joined can now no longer get detached from one another automatically, the subsequent concluding assembly of the two grille sections 1 is supported substantially in this manner. When the sidewalls 6 of the grille sections 1 finally contact one another, the displaceable coupling part 9 slides completely into its insertion position, which, as mentioned already, forms the starting position for its rotation into the locking position.

Due to the form-fit holding action of the annular groove 32 of the displaceable coupling part 9 and the arc-shaped rib 13 of the fixed coupling parts 8 engaging in one another, it is no longer necessary to use manual forces to hold the grille sections 1 to be interconnected in mutual contact before and at the start of the rotation of the displaceable coupling part 9. In this manner the assembly of the grille sections 1 is simplified to a large extent.

Thereafter, the hook wrench 37 with its socket pins 36 is inserted into the receiving holes 35 of the head 28 and the displaceable coupling part 9 is rotated into the locking position shown in FIG. 3 by applying a predetermined target torque. In doing so, the extensions 33 of the crossbar 30 enter the arc-shaped recess 17 of the fixed coupling parts 8. In the course of this rotary motion, the teeth 34 of the extensions 33 of the outer peripheral side 21, expanding in a ramp-like manner, of the arc-shaped rib 18 approach one another and finally slide along under an increasing force effect and thus an increasing frictional resistance on the peripheral side 21. Consequently, the lower peripheral side 21 forms the ramp-type clamping surface 23. The teeth 34 slide over the fluting 24. When the frictional resistance corresponds to the predetermined target torque, and the teeth 34 are located either in one of the depressions 25 or on one of the rising flanks 26, the hook wrench 37 is withdrawn and inserts 40 are each inserted into the receiving holes 35. The pin 41 of the respective insert 40 arrives into that bore 42 of the segment piece 10, which is assigned to the rotational position of the displaceable coupling part 9 attained after the clamping of the same 9. In this manner, the displaceable coupling part 9 is locked absolutely securely even if it 9 has not been rotated properly into the locking position using the prescribed target torque Since, in addition to the locking action of the fluting 24, the displaceable coupling parts 9 are each secured by means of two pins 41, even extraordinary stress of the tree grille, such as e.g. dynamic loads caused by vibrations or brake applications and starting procedures of motor vehicles cannot result in the automatic release of the displaceable coupling part 9 from its locking position.

When rotating the displaceable coupling part 9 into the locking position, the fixed coupling parts 8 are locked in place by tightening them against each other only in the direction extending parallel to the plane E of the grille sections 1, due to which the sidewalls 6 of the various grille sections 1 are pressed against one another in the longitudinal and cross directions. Since the sidewalls 6 are configured such that they extend obliquely inwardly by a small measure, two grille sections 1 that are pressed against one another extend at a very flat angle in relation to the horizontal plane H as shown in FIG. 3. In this manner, a tree grille composed of a plurality of grille sections 1 assumes a flatly upwardly arched shape in its unloaded state, due to which a tree grille of this type is particularly highly loadable.

The inserts 40 bring about not only an absolutely secure locking of the displaceable coupling part 9, but also simultaneously close the topside of the head 28. The inserts 40 can be removed from the receiving holes 35 only with the help of the handling tool 45 shown in FIG. 5, by inserting the L-shaped end pieces 44 into the appropriately designed receiving openings 43, compressing the tool 45 resiliently and finally pulling it upwards with the insert 40. The use of such a special handling tool 45 ensures that unauthorized persons are prevented from removing the inserts 40.

Although the invention has been described with reference to certain specific embodiments, various modifications thereof will be apparent to those skilled in the art without departing from the purpose and scope of the invention as outlined in the claims appended hereto. Any examples provided herein are included solely for the purpose of illustrating the invention and are not intended to limit the invention in any way. Any drawings provided herein are solely for the purpose of illustrating various aspects of the invention and are not intended to be drawn to scale or to limit the invention in any way. The disclosures of all prior art recited herein are incorporated herein by reference in their entirety.

The invention claimed is:

1. A tree grille system for covering tree grates, said tree grille system comprising:

a) several grille sections, said sections being interconnected by couplings to form a continuous, self-supporting tree grille, the outer edge of which rests on a support bearing;

b) said couplings consisting of two fixed coupling parts, which are each configured on two adjoining grille sections and which are arranged at a distance between one another, and a displaceable coupling part, which can be inserted between the two fixed coupling parts and then rotated into a locking position;

c) the fixed coupling parts U formed of segment pieces comprising a ramp-type clamping surface;

d) at least one part of the ramp-type clamping surface being provided with a flat undulating or dented fluting;

e) the displaceable coupling part comprising a discoidal head having two receiving holes for a hook wrench, a bolt-shaped center part and a two-armed cross bar having an upwardly directed extension on each arm, wherein said extensions are adapted to engage the ramp-type clamping surfaces;

f) at least one flat tooth provided on the extensions, said tooth being capable of being locked into place in depressions of the fluting;

g) an arc-shaped recess, which extends parallel to the plane of the grille sections and an arc-shaped rib, which delimits the recess and likewise extends parallel to the plane of the grille sections, said recess and arc being provided on the underside of the segment pieces, and wherein the ramp-type clamping surface is formed on the outer peripheral side of the rib;

h) at least one part of the outer peripheral side of the rib being provided with the flat undulating or dented fluting;

i) said tooth, which is capable of being locked into place in the fluting, being configured on the inner side of both the extensions; and j) the system further including inserts, each capable of being inserted into the receiving holes of the displaceable coupling part and thereby filling the receiving hole, engage with a downwardly projecting pin in one of several bores disposed in a circular arc-shaped manner in the respective segment piece of both the fixed coupling parts.

2. The tree grille system according to claim 1, wherein sidewalls of the grille sections are configured such that they extend by a small measure obliquely inwardly starting from their topside.

3. The tree grille system according to claim 1, wherein one bore for the pin of the associated insert is assigned to each depression and each rising flank of the fluting.

4. The tree grille system according to claim 1, wherein the inserts comprise receiving openings for a handling tool.

5. The tree grille system according to claim 2, wherein one bore for the pin of the associated insert is assigned to each depression and each rising flank of the fluting.

6. The tree grille system according to claim 2, wherein the inserts comprise receiving openings for a handling tool.

7. The tree grille system according to claim 3, wherein the inserts comprise receiving openings for a handling tool.

* * * * *

UNITED STATES PATENT AND TRADEMARK OFFICE

CERTIFICATE OF CORRECTION

PATENT NO. : 7,637,687 B2
APPLICATION NO. : 11/575439
DATED : December 29, 2009
INVENTOR(S) : Georg Wagner It is certified that error appears in the above-identified patent and that said Letters Patent is hereby corrected as shown below:

Column 6, line 52 to column 8, line 5, please replace Claim 1 with the following:

1. A tree grille system for covering tree grates, said tree grille system comprising:

a) several grille sections, said sections being interconnected by couplings to form a continuous, self-supporting tree grille, the outer edge of which rests on a support bearing;

b) said couplings consisting of two fixed coupling parts, which are each configured on two adjoining grille sections and which are arranged at a distance between one another, and a displaceable coupling part, which can be inserted between the two fixed coupling parts and then rotated into a locking position;

c) the fixed coupling parts [U] <u>are</u> formed of segment pieces comprising a ramp-type clamping surface;

d) at least one part of the ramp-type clamping surface being provided with a flat undulating or dented fluting;

e) the displaceable coupling part comprising a discoidal head having two receiving holes for a hook wrench, a bolt-shaped center part and a two-armed cross bar having an upwardly directed extension on each arm, wherein said extensions are adapted to engage the ramp-type clamping surfaces;

f) at least one flat tooth provided on the extensions, said tooth being capable of being locked into place in depressions of the fluting;

g) an arc-shaped recess, which extends parallel to the plane of the grille sections and an arc-shaped rib, which delimits the recess and likewise extends parallel to the plane of the grille sections, said recess and arc being provided on the underside of the segment pieces, and wherein the ramp-type clamping surface is formed on the outer peripheral side of the rib;

h) at least one part of the outer peripheral side of the rib being provided with the flat undulating or dented fluting;

i) said tooth, which is capable of being locked into place in the fluting, being configured on the inner side of both the extensions; and j) the system further including inserts, each capable of being inserted into the receiving holes of the displaceable coupling part and thereby filling the receiving hole, engage with a downwardly projecting pin in one of several bores disposed in a circular arc-shaped manner in the respective segment piece of both the fixed coupling parts.

Signed and Sealed this

Sixteenth Day of March, 2010

David J. Kappos

David J. Kappos
*Director of the United States Patent and Trademark Office*